US012529200B2

(12) United States Patent
Cler

(10) Patent No.: US 12,529,200 B2
(45) Date of Patent: Jan. 20, 2026

(54) LINEAR ACTUATOR-BASED RIDE CONTROL

(71) Applicant: Caterpillar Inc., Peoria, IL (US)

(72) Inventor: Eric W. Cler, Oswego, IL (US)

(73) Assignee: Caterpillar Inc., Peoria, IL (US)

( * ) Notice: Subject to any disclaimer, the term of this patent is extended or adjusted under 35 U.S.C. 154(b) by 272 days.

(21) Appl. No.: 18/221,715

(22) Filed: Jul. 13, 2023

(65) Prior Publication Data

US 2025/0019924 A1 Jan. 16, 2025

(51) Int. Cl.
*E02F 3/42* (2006.01)
*E02F 3/43* (2006.01)
*E02F 9/20* (2006.01)

(52) U.S. Cl.
CPC ..... *E02F 3/422* (2013.01); *E02F 3/432* (2013.01); *E02F 9/2029* (2013.01)

(58) Field of Classification Search
CPC ..... E02F 3/422; E02F 3/432; E02F 9/2029
See application file for complete search history.

(56) References Cited

U.S. PATENT DOCUMENTS 8,387,378 B2 3/2013 Payne et al.
8,930,052 B2 1/2015 Whitfield
9,150,396 B2 10/2015 Umehara et al.
10,518,654 B2 12/2019 Nada
11,091,899 B1 8/2021 Kenkel et al.
2008/0210505 A1* 9/2008 Vigholm ..... E02F 9/2207 188/266.2
2012/0303225 A1 11/2012 Futahashi et al.
2021/0261393 A1 8/2021 Imaoka et al.
2023/0228058 A1 7/2023 Young

FOREIGN PATENT DOCUMENTS

KR 20130055302 5/2013

* cited by examiner

*Primary Examiner* — Kenneth M Dunne

(57) ABSTRACT

A work machine includes a load bucket and operator controls for controlling position of the load bucket. The work machine can include an actuator assembly coupled to hold the load bucket in a position based upon signals from the operator controls. The actuator assembly can include a motor and a brake assembly. The brake assembly can include a non-spring-coupled brake and a spring-coupled brake. The work machine can further include control circuitry coupled to the actuator assembly to activate the spring-coupled brake responsive to detection that the non-spring-coupled brake is holding the load bucket stationary. The control circuitry can further control the motor to apply additional braking force upon detecting that a magnitude of oscillation of the work machine exceeds a threshold magnitude based on a damping coefficient of the spring-coupled brake.

20 Claims, 5 Drawing Sheets

LINEAR ACTUATOR-BASED RIDE CONTROL

TECHNICAL FIELD

This document relates to movement control on work machines and in particular to techniques of reducing or eliminating oscillations and other detrimental machine movement during travel of the work machines over uneven terrain.

BACKGROUND

During work machine operations some work machines, such as wheel loaders, may travel over uneven terrain with a loaded work tool. During travel, the work machine may oscillate or "bounce" in one or more directions, leading to reduced rider comfort and safety concerns caused by difficulties in controlling the work machine. In some cases, oscillation may become so intense that the operator must reduce ground speed of the work machine, leading to inefficiency and increased costs of work machine operations. Some available wheel loaders are equipped with a ride control system that hydraulically connects a load bearing side of lift cylinders to a hydraulic accumulator. The accumulator and associated lines and orifices allow the linkage to move up and down gently, and act as a spring/damper system tuned to damp out the machine oscillations. However, some modern systems today replace these hydraulic cylinders with linear actuators, which rigidly hold the load/loaded work tool and do not provide functionality to control machine oscillations.

U.S. Pat. No. 8,930,052 discusses controlling a drive system for mobile equipment wherein electric traction motors are controlled by a torque controller to provide uniform torque.

SUMMARY OF THE INVENTION

Work machines often travel over uneven terrain with a loaded work tool. On uneven terrain, the machine may start to bounce. An excessive bouncing makes the machine difficult to operate, and an operator must slow down the machine substantially to tamp down the oscillations. Some available wheel loaders include ride control systems that hydraulically connects a load bearing side of lift cylinders to a hydraulic accumulator to use the lift linkage to lift the load to act as a damper of machine oscillations. However, some work machines do not include hydraulic lift cylinders and instead control lift using linear actuators.

To address these and other concerns, an example work machine can include a load bucket and operator controls for controlling position of the load bucket. The work machine can further include an actuator assembly coupled to the load bucket and configured to hold the load bucket in a position based upon signals from the operator controls. The actuator assembly can include a motor and a brake assembly. The brake assembly can include a non-spring-coupled brake and a spring-coupled brake. Control circuitry coupled to the actuator assembly can activate the spring-coupled brake responsive to detection that the non-spring-coupled brake is holding the load bucket stationary. The control circuitry can control the motor to apply additional braking force upon detecting that a magnitude of oscillation of the work machine exceeds a threshold magnitude based on a damping coefficient of the spring-coupled brake.

DETAILED DESCRIPTION

Examples according to this disclosure are directed to control circuitry to monitor various parameters of a work machine as it travels over terrain. As the work machine moves, oscillations can occur. These oscillations can create discomfort for the work machine operator and can make it difficult for the work machine operator to control machine tool operations.

Figure 1:
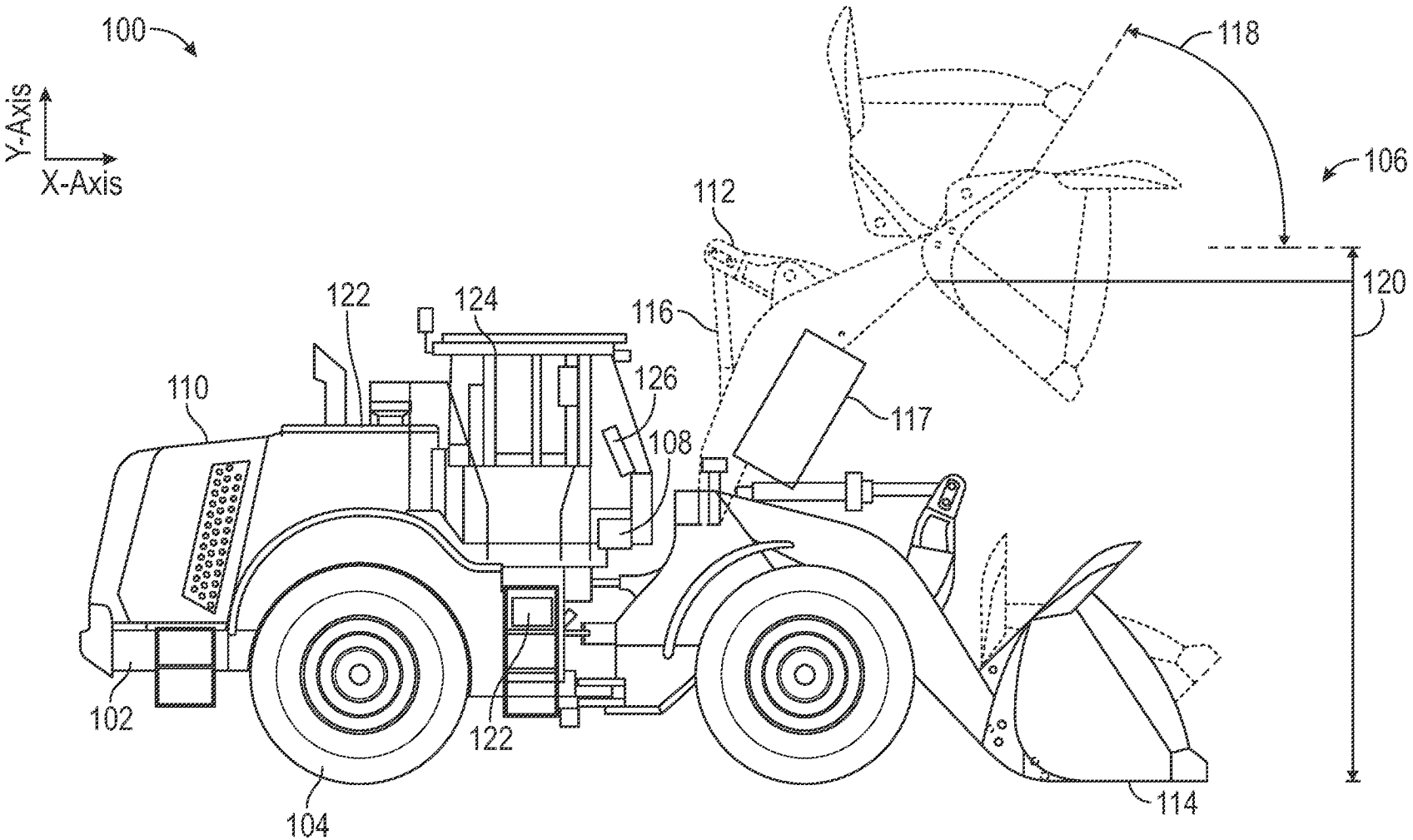
FIG. 1 is an elevation view depicting an example work machine in accordance with this disclosure.

FIG. 1 depicts an example machine 100 in accordance with this disclosure. In FIG. 1, machine 100 includes frame 102, wheels 104, implement 106, and a speed control system implemented in one or more on-board electronic devices like, for example, an electronic control unit or ECU 108. Example machine 100 is a wheel loader. In other examples, however, the machine may be other types of machines related to various industries, including, as examples, construction, agriculture, forestry, transportation, material handling, waste management, and so on. Accordingly, although a number of examples are described with reference to a wheel loader machine, examples according to this disclosure are also applicable to other types of machines including graders, scrapers, dozers, excavators, compactors, material haulers like dump trucks, along with other example machine types.

Machine 100 includes frame 102 mounted on four wheels 104, although, in other examples, the machine could have more or fewer than four wheels. Frame 102 is configured to support and/or mount one or more components of machine 100. For example, machine 100 includes enclosure 110 coupled to frame 102. Enclosure 110 can house, among other components, a motor to propel the machine over various terrain via wheels 104. In some examples, multiple motors are included in multiple enclosures at multiple locations of the machine 100.

Machine 100 includes implement 106 coupled to the frame 102 through linkage assembly 112, which is configured to be actuated to articulate bucket 114 of implement 106. Bucket 114 of implement 106 may be configured to transfer material, such as soil or debris, from one location to another. Linkage assembly 112 can include one or more cylinders 116 configured to be actuated hydraulically or pneumatically, for example, to articulate bucket 114. For example, linkage assembly 112 can be actuated by cylinders 116 to raise and lower and/or rotate bucket 114 relative to frame 102 of machine 100. Actuators 117 (e.g., electric linear actuators (ELAs)) can be provided for holding linkage weight (e.g., the material weight within the bucket 114) instead of hydraulic cylinders such as those provided at 116. For example, the bucket 114 can be held in position (e.g., as shown with phantom lines in FIG. 1) using the actuators 117. The bucket 114 can be swung at an angle shown at 118, lifted by a height 120, etc.

Platform 122 is coupled to frame 102 and provides access to various locations on machine 100 for operational and/or maintenance purposes. Machine 100 also includes an operator cabin 124, which can be open or enclosed and may be accessed via platform 122. Operator cabin 124 may include one or more control devices 126 such as, a joystick, a steering wheel, pedals, levers, buttons, switches, among other examples. The control devices 126 are configured to enable the operator to control machine 100 and/or the implement 106. Operator cabin 124 may also include an operator interface, such as a display device, a sound source, a light source, or a combination thereof.

Machine 100 can be used in a variety of industrial, construction, commercial, or other applications. Machine 100 can be operated by an operator in operator cabin 124 or a remote operator. The operator can, for example, drive machine 100 to and from various locations on a work site and can also pick up and deposit loads of material using bucket 114 of implement 106. Autonomous operation is also possible. As an example, machine 100 can be used to excavate a portion of a work site by actuating cylinders 116 or actuators 117 to articulate bucket 114 via linkage 112 to dig into and remove dirt, rock, sand, etc. from a portion of the work site and deposit this load in another location.

During travel to or from a work site or within a work site, the machine 100 may travel over uneven terrain with a loaded work tool (e.g., bucket 114). For example, the work tool may be loaded with rock, sand, dirt, etc. that has been removed or dug from the work site or that is being provided to the work site. On uneven terrain, the machine 100 may start to oscillate along the X-axis or bounce along the Y-axis. An excessive bouncing makes the machine difficult to operate, and an operator must slow down the machine substantially to tamp down the oscillations.

Some machines 100 available today can include a ride control system that hydraulically connects a load bearing side of lift cylinders to a hydraulic accumulator (e.g., along the location indicated at actuator 117). This accumulator (including any lines and orifices) can allow the linkage to move up and down gently, thereby acting as a spring/damper system tuned to damp out the machine 100 oscillations. Such ride control systems typically are engaged when the machine 100 ground speed exceeds a threshold (e.g., over 10 miles per hour, over 20 miles per hour, or other manufacturer-specified ground speed).

However, some machines 100 today may use actuators (e.g., linear actuators or electronic linear actuators (ELAs)) in place of hydraulic cylinders and ride control could be provided for these work machines 100 as well. For example, the actuator can be similar to the actuator shown in FIG. 2.

Figure 2:
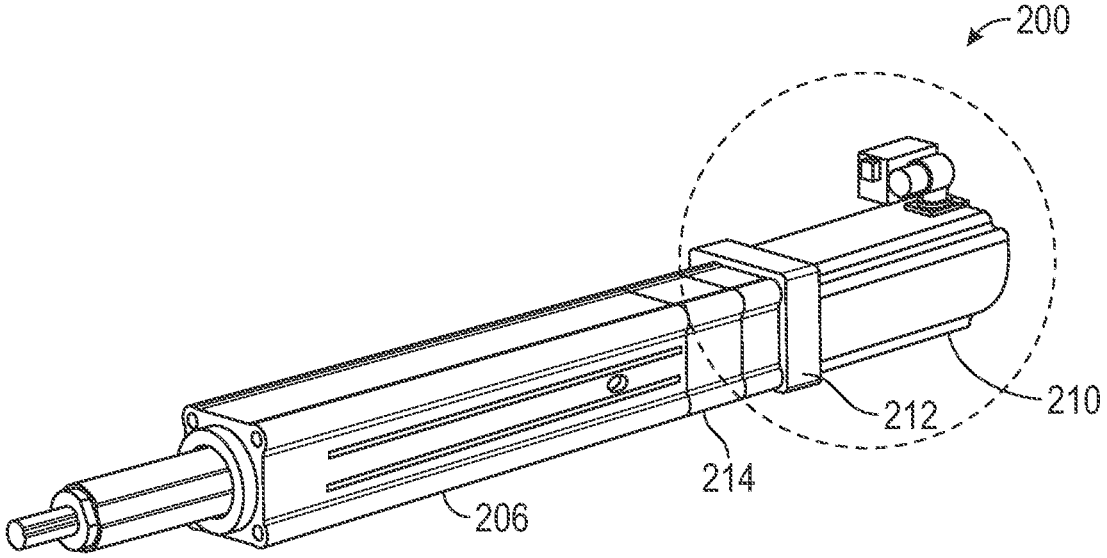
FIG. 2 is a perspective view of a linear actuator in accordance with this disclosure.

FIG. 2 is a perspective view of a linear actuator 200 in accordance with this disclosure. The linear actuator 200 is shown as an example and other similar types of actuators can be employed in various embodiments. For example, actuators can include rack and pinion actuators, ball and screw actuators, etc.

The actuator 200 can include a gearbox 212. The gearbox 212 can include a housing 214 which fits on one side to the linear unit 206 and fits on the other side to a motor adapter 210. The gearbox 212 can transmit motor torque directly to the linear unit 206. The motor adapter 210 can include an AC induction motor, can run on battery power, and/or can include a brake (e.g., an electromagnetic brake and, in some examples, an additional centrifugal brake).

The ELA 200 (and similar ELAs in various other embodiments) can hold a load by using a mechanical brake on a motor shaft or an actuator mechanism, which rigidly holds the loads without energizing the motor. However, this rigid brake does not provide a mechanism for the linkage to move during travel, and therefore machine oscillations or "bouncing" may be present, adding to operator discomfort and making it difficult for operators to control machines.

Systems and methods according to embodiments address these and other concerns by providing different modes of operation for ELAs that provide different types or sources of braking depending on criteria such as ground speed, load, oscillation magnitude and other variables. The different modes of operation can be executed or controlled using circuitry components as described with reference to FIG. 3.

Figure 3:
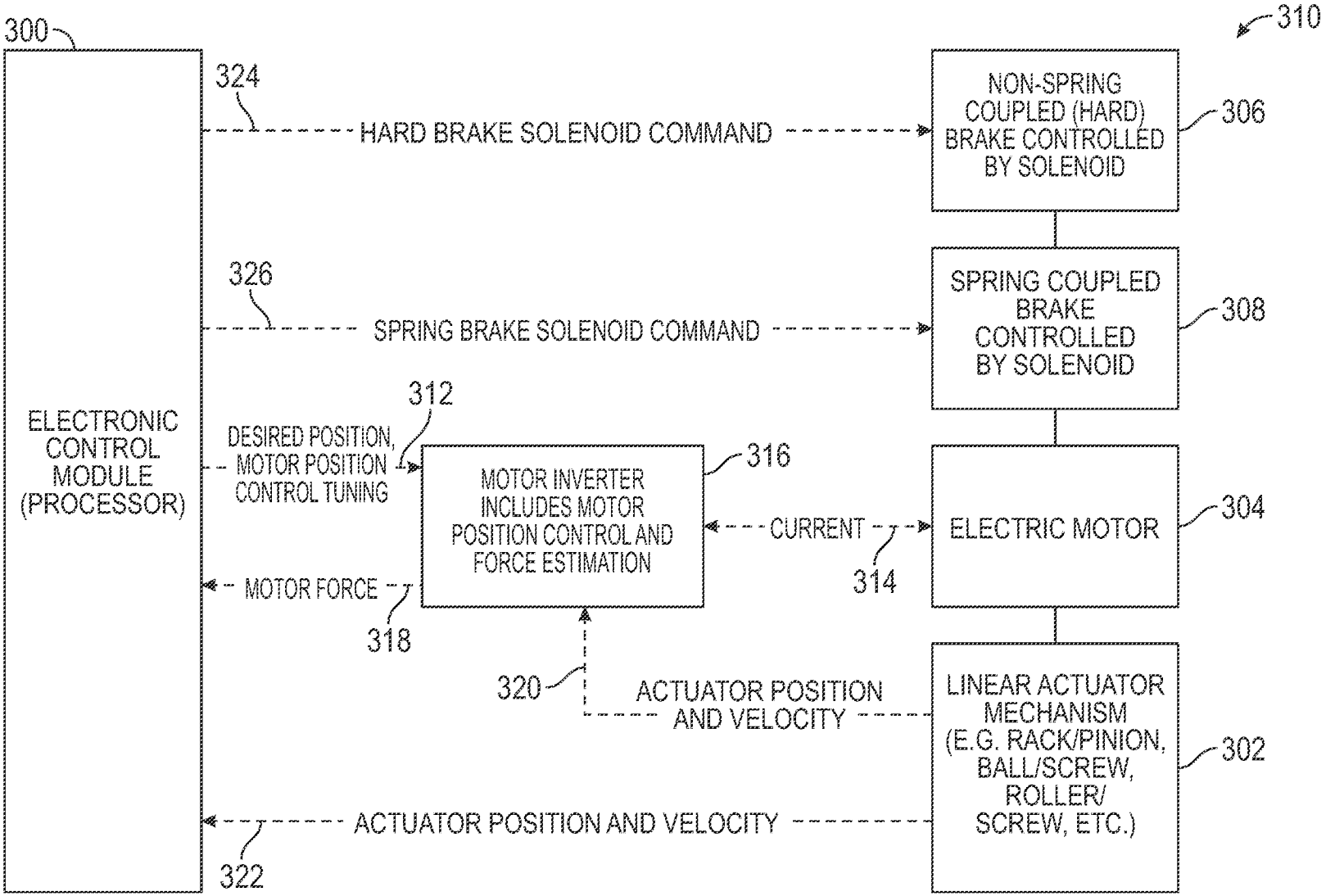
FIG. 3 is a block diagram of components for ride control in accordance with this disclosure.

FIG. 3 is a block diagram of components for ride control in accordance with this disclosure. Control circuitry 300 can provide control signals and an apparatus for ride control can include an actuator assembly and control circuitry as described below. For example, an actuator assembly can include a linear actuator mechanism 302 as described above with reference to the example ELA described with respect to FIG. 2. An electric motor 304 can be associated with the linear actuator mechanism 302 as described above with reference to FIG. 2. For example, the electric motor 304 can include some or all components of the motor adapter 210 or can couple to the motor adapter 210 (FIG. 2). As also described above, a motor brake 306 can be provided in an assembly with the electric motor 304.

In embodiments, a compression-coupled (e.g., spring-coupled) brake 308 is added for movement damping, under conditions and according to criteria described below. The brake 308 can comprise a compressive element or spring (for example a torsional spring although embodiments are not limited thereto) between the brake 306 and the motor shaft of the motor 304. The brake 308 can allow the motor shaft to freely oscillate around a central position. Taken together, the motor brake 306 (e.g., non-spring-coupled brake), the brake 308 (e.g., spring-coupled brake) and motor 304 can be referred to as an actuator assembly 310.

Some or all of the components shown in FIG. 3 can couple to the load bucket 114 (FIG. 1) to hold the load bucket 114 in a position based upon signals from the operator controls (e.g., controls 126 (FIG. 1)). When no brake is applied (for example, when the motor torque of the motor described in FIG. 2 is holding the load), the control circuitry 300 can execute a control algorithm (in software or firmware for example). The algorithm can monitor output motor torque and velocity to measure in real-time the magnitude and frequency of oscillations using circuitry and signals shown in FIG. 3.

For example, the control circuitry 300 can provide signals 312 to control the current 314 and other parameters of the motor 304. The control circuitry 300 can implement this control by providing the signals 312 to inverter 316. The inverter 316 can control the frequency of power supplied to the motor 304 to control the rotation speed of the motor 304. Without inverter 316, motor 304 would operate at full speed as soon as power is provided to the motor 304.

The inverter 316 can provide feedback 318 to the control circuitry 300. The feedback 318 can include parameters such as, for example, motor force of the motor 304. The linear actuator mechanism 302 can provide actuator position and velocity information to the inverter 316 using signal 320. In addition or alternatively, the linear actuator mechanism 302 can provide actuator position and velocity information to the control circuitry 300 using signal 322. The control circuitry 300 can also control brakes 306, 308 by providing solenoid commands 324, 326, respectively.

In some embodiments, other circuitry or devices not shown in FIG. 3 can provide information to the control circuitry 300. For example, oscillations of the machine can be measured by inertial measurement units that include, for example, accelerometers and gyroscopes. In some examples, the control circuitry 300 can update the motor torque command using signal 312 at each moment in time to counteract and dampen the oscillations.

In some embodiments, when the brake is applied (for example, when the motor torque of an example motor described in FIG. 2 are not holding the load) the non-spring-coupled brake 306 will typically be applied using solenoid command 324. The spring-coupled brake 308 can be gradually applied according to the algorithm shown in FIG. 4.

Figure 4:
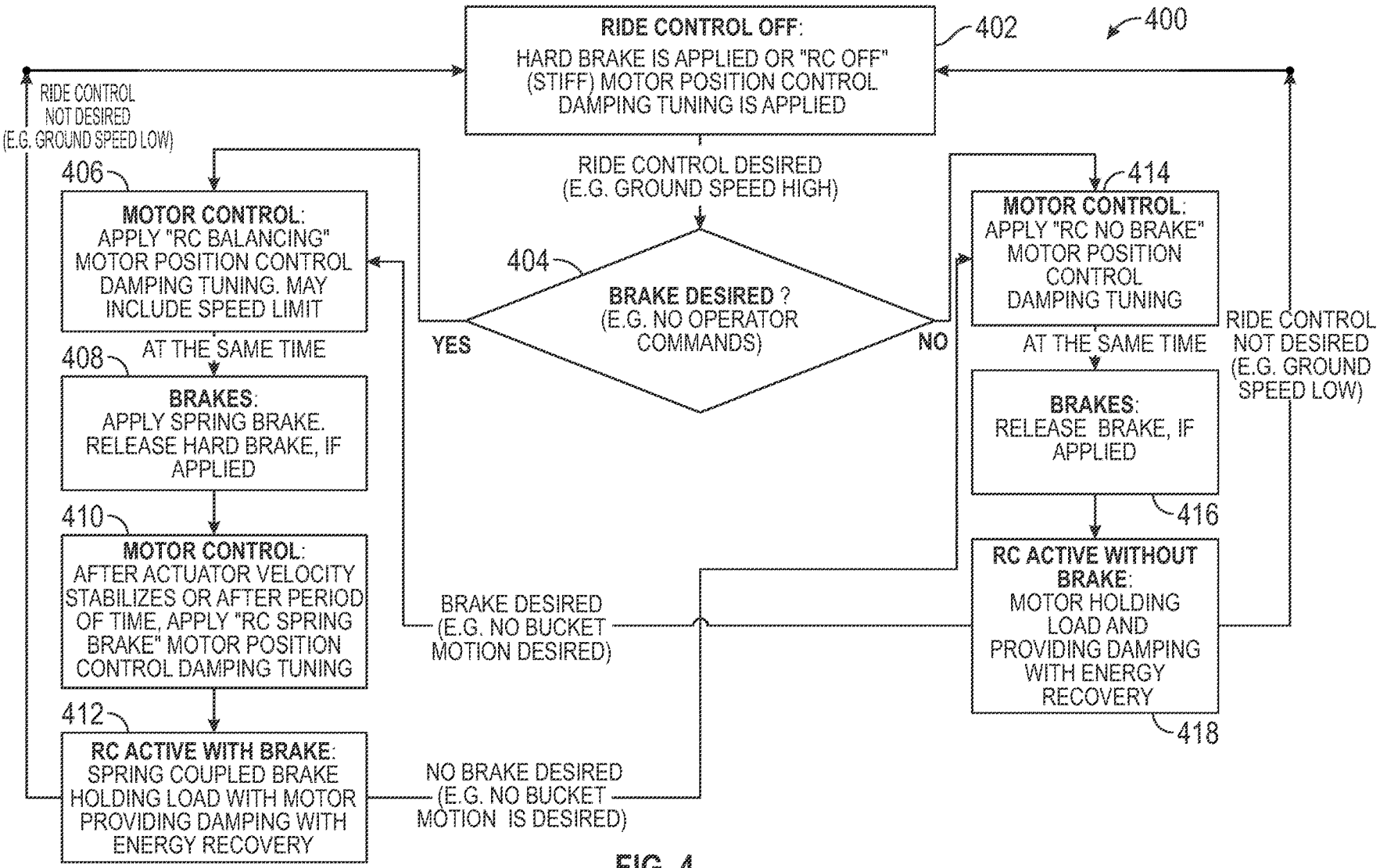
FIG. 4 is a flow chart of a method for providing ride control in accordance with this disclosure.

FIG. 4 is a flow chart of a method 400 for providing ride control using the spring-coupled brake 308 in accordance with this disclosure. The method 400 can begin at operation 402 with ride control being in an "off" state, for example when ride control is not desired due to ground speed being below a threshold. Other threshold parameters can be used for determining when ride control is desired or should be activated. At operation 402, as described above, before ride control is implemented, the non-spring-coupled brake 306 may be applied, and the motor torque of motors associated with ELAs will typically not be holding the load.

When ground speed exceeds a threshold, ride control may be desired to increase operator comfort and control. At operation 404, the control circuitry 300 can detect if braking is desired based on, for example, signaling provided by controls 126 (FIG. 1). In the absence of operator commands at controls 126, braking is desired beginning with operation 406 in the left branch of method 400 as shown in FIG. 4.

At operation 406, the control circuitry 300 can perform balancing to gradually shift from using the non-spring-coupled brake 306 to using the spring-coupled brake 308. In some examples, activation of the spring-coupled brake 308 can occur responsive to (or upon) detecting that the non-spring-coupled brake 306 is holding the load stationary. For example, if the operator is not performing commands (as determined at operation 404), the control circuitry 300 can determine that the non-spring-coupled brake 306 is holding the load stationary. The speed at which this switching occurs can be limited or controlled, with the end result being that the spring-coupled brake 308 is eventually applied at operation 408. During operation 406, the spring-coupled brake 308 is gradually applied and the non-spring-coupled brake 306 is gradually released. During this balancing, the load may drop slightly until the load is caught by the spring-coupled brake 308 and motor 304 control may be applied during that time to hold the load stable.

The control circuitry 300 can monitor signal 318 (FIG. 3) to detect how much motor force is being used to support the load (e.g., whether the load is fully supported by motor force can be used to determine how much of that burden has been shifted to the spring-coupled brake 308). Once the motor force drops to zero or about zero, the control circuitry 300 can determine that the spring-coupled-brake 308 is bearing the entire load (e.g., fully supporting the load). The control circuitry 300 (or other control circuitry of the machine 100) may perform position control of the load using the spring-coupled brake 308 after this balancing is complete. The parameters that provided the position control can be saved or updated. For example, filters and constants for proportional-integral-derivative (PID) controllers for providing position control will subsequently be updated or determined based on the spring-coupled brake rather than on the motor 304. Subsequent to determining that the spring-coupled-brake 308 is bearing the entire load, the control circuitry 300 can monitor the work machine for oscillations (using, e.g., accelerometers, etc.). If the magnitude of these oscillations or other movement is detected to be above a threshold, the control circuity 300 can apply additional braking force using other brakes (e.g., the non-spring-loaded brake 306) to dampen oscillations.

At operation 410, when the motor force is zero and the spring-coupled brake 308 is supporting the entire load, the motor 304 can be used for damping. When damping is done with the motor 304, energy can be recovered from the motor 304 and into the motor power source or for other electrical uses of the machine 100. Operation 412 therefore reflects a state in which the spring-coupled brake 308 is holding the load and the motor is providing damping and energy recovery power generation, resulting in some additional energy recovery. Once operation 412 has been reached or achieved, when the ground speed decreases, the ride control may be turned off and the non-spring-coupled brake 306 may be applied and the spring-coupled brake 308 can be deactivated (e.g., operations may be resume at operation 402). Otherwise, the machine 100 can be maintained at operation 412.

Alternatively, if the load is borne by the spring-coupled brake 308 and braking is no longer desired (e.g., if bucket 114 motion is desired), then operations may change to the right side of the flowchart with operation 414. Operation 414 can generally be performed when ride control is desired and the non-spring-coupled brake 306 is to be turned "off," for example if a small bucket "lift" is desired while the machine 100 is moving at a traveling speed. Therefore at operation 416 the non-spring-coupled brake 306 is released (e.g., the control circuitry 300 can provide a solenoid command 324 to turn off the non-spring-coupled brake 306). The motor 304 will thereafter be holding the whole load at operation 418, in addition to providing oscillation damping. If no bucket motion is desired, operations may move to the left side of the flowchart at operation 406, for balancing with spring-coupled brake 308. Similarly, if ground speed falls below a traveling threshold, ride control may be removed and operations may resume at operation 402.

Figure 5:
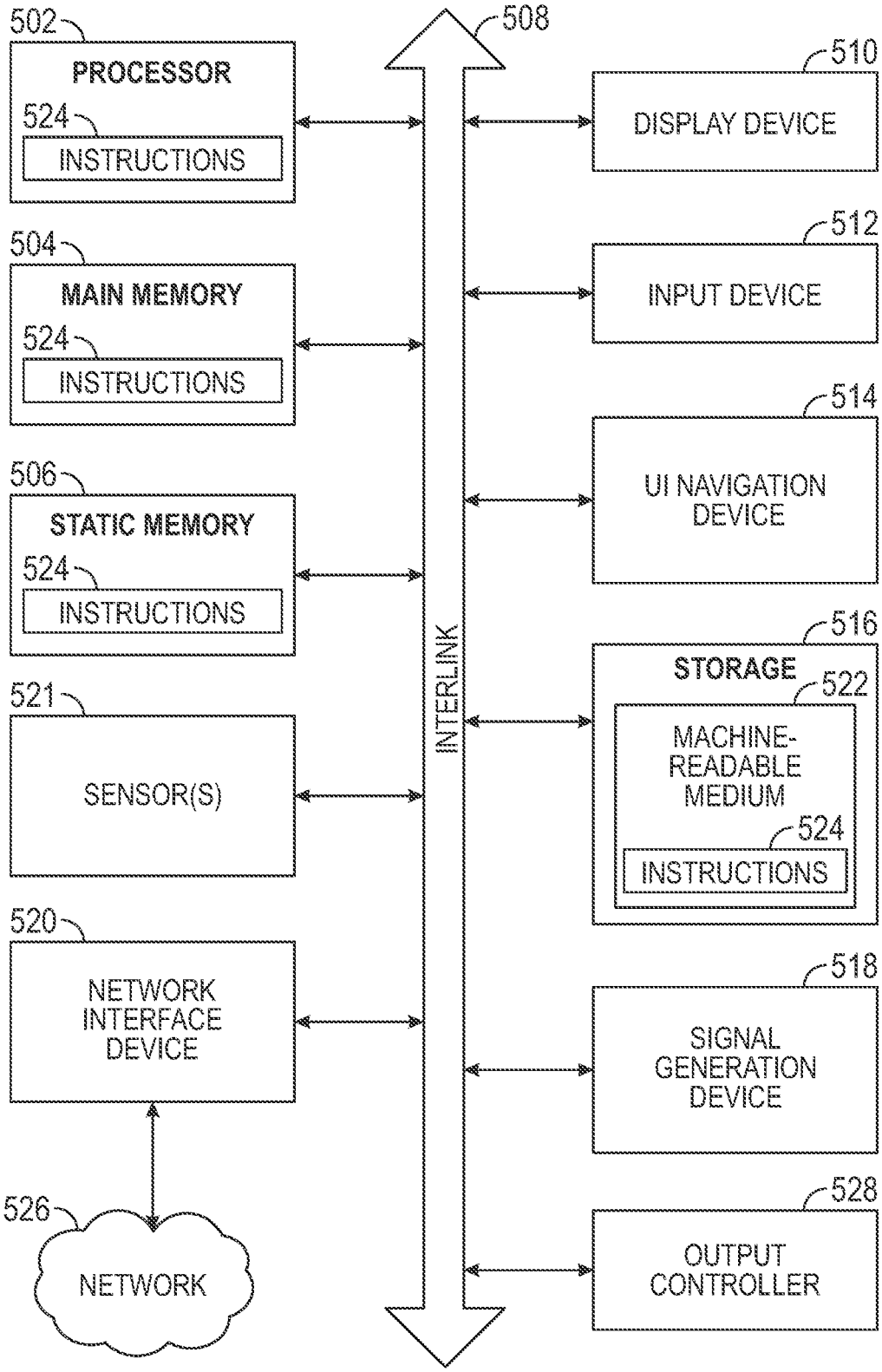
FIG. 5 is a computer system on which example embodiments can be implemented.

FIG. 5 illustrates generally an example of a block diagram of a machine 500 upon which any one or more of the techniques (e.g., methodologies) discussed herein may perform in accordance with some embodiments. In examples, the machine 500 may include control circuitry or execute instructions associated with ride control and control of activation solenoids to control spring-coupled brakes and motors associated with ELAs as described herein. In alternative embodiments, the machine 500 may operate as a standalone device or may be connected (e.g., networked) to other machines. The machine 500 can act as control circuitry 300 or perform one or more of the operations of control circuitry 300 or provide communication inputs or outputs from the control circuitry 300 to operators either remote or local to the work machine 100.

Examples, as described herein, may include, or may operate on, logic or a number of components, modules, or mechanisms. Modules are tangible entities (e.g., hardware) capable of performing specified operations when operating. A module includes hardware. In an example, the hardware may be specifically configured to carry out a specific operation (e.g., hardwired). In an example, the hardware may include configurable execution units (e.g., transistors, circuits, etc.) and a computer-readable medium containing instructions, where the instructions configure the execution units to carry out a specific operation when in operation. The configuring may occur under the direction of the execution units or a loading mechanism. Accordingly, the execution units are communicatively coupled to the computer-readable medium when the device is operating. In this example, the execution units may be a member of more than one module. For example, under operation, the execution units may be configured by a first set of instructions to implement a first module at one point in time and reconfigured by a second set of instructions to implement a second module.

Machine (e.g., computer system) 500 may include a hardware processor 502 (e.g., a central processing unit (CPU), a graphics processing unit (GPU), a hardware processor core, or any combination thereof), a main memory 504 and a static memory 506, some or all of which may communicate with each other via an interlink (e.g., bus) 508. The machine 500 may further include a display unit 510, an alphanumeric input device 512 (e.g., a keyboard), and a user interface (UI) navigation device 514 (e.g., a mouse). In an example, the display unit 510, alphanumeric input device 512 and UI navigation device 514 may be a touch screen display. The machine 500 may additionally include a storage device (e.g., drive unit) 516, a signal generation device 518 (e.g., a speaker), a network interface device 520, and one or more sensors 521, such as a global positioning system (GPS) sensor, compass, accelerometer, or other sensor. The machine 500 may include an output controller 528, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 516 may include a machine-readable (or computer-readable) medium 522 that is non-transitory on which is stored one or more sets of data structures or instructions 524 (e.g., software) embodying or utilized by any one or more of the techniques or functions described herein. The instructions 524 may also reside, completely or at least partially, within the main memory 504, within static memory 506, or within the hardware processor 502 during execution thereof by the machine 500. In an example, one or any combination of the hardware processor 502, the main memory 504, the static memory 506, or the storage device 516 may constitute machine readable media.

While the machine readable medium 522 is illustrated as a single medium, the term "machine readable medium" may include a single medium or multiple media (e.g., a centralized or distributed database, or associated caches and servers) configured to store the one or more instructions 524.

The term "machine readable medium" may include any medium that is capable of storing, encoding, or carrying instructions for execution by the machine 500 and that cause the machine 500 to perform any one or more of the techniques of the present disclosure, or that is capable of storing, encoding or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices: magnetic disks, such as internal hard disks and removable disks: magneto-optical disks: and CD-ROM and DVD-ROM disks.

The instructions 524 may further be transmitted or received over a communications network 526 using a transmission medium via the network interface device 520 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), a legacy telephone network, and wireless data networks (e.g., Institute of Electrical and Electronics Engineers (IEEE) 802.11 family of standards known as Wi-FiR, IEEE 802.16 family of standards known as WiMax®), IEEE 802.15.4 family of standards, peer-to-peer (P2P) networks, among others. In an example, the network interface device 520 may include one or more physical jacks (e.g., Ethernet, coaxial, or phone jacks) or one or more antennas to connect to the communications network 526. In an example, the network interface device 520 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 500, and includes digital or analog communications signals or other intangible medium to facilitate communication of such software.

INDUSTRIAL APPLICABILITY

In an operating example of a work machine, some work machines may travel on rubber tires that bounce and lead to operator discomfort and a lack of control. Therefore, systems described herein provide a spring-loaded brake together with other braking systems in a linear actuator that bears loads (e.g., loads within a load bucket). Lifting and load bearing is provided by the spring in some situations to allow counterbalance and energy capture to reduce bouncing and other unwanted movement.

The above detailed description is intended to be illustrative, and not restrictive. The scope of the disclosure should, therefore, be determined with references to the appended claims, along with the full scope of equivalents to which such claims are entitled.

What is claimed is:

1. A work machine comprising:

a load bucket;

operator controls for controlling position of the load bucket;

an actuator assembly coupled to the load bucket and configured to hold the load bucket in a position based upon signals from the operator controls, the actuator assembly including a motor and a brake assembly, the brake assembly including a non-spring-coupled brake and a spring-coupled brake; and control circuitry coupled to the actuator assembly, the control circuitry configured to:

activate the spring-coupled brake responsive to detection that the non-spring-coupled brake is holding the load bucket stationary; and control the motor to apply additional braking force upon detecting that a magnitude of oscillation of the work machine exceeds a threshold magnitude.

2. The work machine of claim 1, wherein the control circuitry is configured to control the non-spring-coupled brake to remove braking force applied by the non-spring-coupled brake upon detecting that the load is fully supported by the spring-coupled brake.

3. The work machine of claim 1, wherein the spring-coupled brake includes a spring provided between the non-spring-coupled brake and a motor shaft of the motor.

4. The work machine of claim 1, wherein the control circuitry is configured to detect motor torque of the motor to determine whether the motor or the brake assembly is holding the load bucket stationary.

5. The work machine of claim 1, wherein the control circuitry is configured to deactivate the spring-coupled brake and activate the non-spring-coupled brake upon operator controls indicating that load bucket movement is to be initiated.

6. The work machine of claim 1, wherein the actuator includes an electric linear actuator (ELA).

7. The work machine of claim 6, wherein the actuator assembly includes a rack and pinion system or a ball and screw system.

8. The work machine of claim 1, comprising:

ground speed detection circuitry configured to detect ground speed of the work machine, and wherein the control circuitry is to refrain from activating the spring-coupled brake until the ground speed exceeds a threshold.

9. The work machine of claim 8, wherein the control circuitry is configured to deactivate the spring-coupled brake upon detection that the ground speed has fallen below the threshold.

10. The work machine of claim 1, wherein the work machine is a wheel loader.

11. The work machine of claim 1, wherein the control circuitry is configured to control the brake assembly using respective solenoids for each of the non-spring-coupled brake and the spring-coupled brake.

12. The work machine of claim 1, wherein the control circuitry is configured to, responsive to detecting a motor torque level indicating that the motor is holding the load bucket stationary, control the motor to apply additional braking force upon detecting that the oscillation of the work machine exceeds the threshold magnitude based on a damping coefficient of the spring-coupled brake.

13. An apparatus comprising:

an actuator assembly comprising a motor and a brake assembly, the brake assembly including a non-spring-coupled brake and a spring-coupled brake; and control circuitry coupled to the actuator assembly, the control circuitry configured to:

activate the spring-coupled brake responsive to detection that the non-spring-coupled brake is holding a load; and control the motor to apply additional braking force upon detecting motion that exceeds a threshold magnitude, the threshold being based on a damping coefficient of the spring-coupled brake.

14. The apparatus of claim 13, wherein the control circuitry is configured to control the non-spring-coupled brake to remove braking force applied by the non-spring-coupled brake upon detecting that the load is fully supported by the spring-coupled brake.

15. The apparatus of claim 13, wherein the spring-coupled brake includes a torsion spring and wherein the torsion spring is provided between the non-spring-coupled brake and a motor shaft of the motor to allow oscillation of the motor shaft.

16. The apparatus of claim 13, wherein the control circuitry is configured to detect motor torque of the motor to determine whether the motor or the brake assembly is holding the load.

17. The apparatus of claim 13, wherein the control circuitry is configured to deactivate the spring-coupled brake and activate the non-spring-coupled brake upon receiving an indication that load movement is to be initiated.

18. The apparatus of claim 13, wherein the actuator includes an electric linear actuator (ELA).

19. A non-transitory computer-readable medium including instructions that, when executed on control circuitry, cause the control circuitry to perform operations including:

activating a spring-coupled brake responsive to detection that a non-spring-coupled brake is holding a load bucket stationary; and controlling a motor to apply additional braking force upon detecting that a magnitude of oscillation of a work machine exceeds a threshold magnitude based on a damping coefficient of the spring-coupled brake.

20. The non-transitory computer-readable medium of claim 19, wherein the control circuitry is configured to control the non-spring-coupled brake to remove braking force applied by the non-spring-coupled brake upon detecting that the load is fully supported by the spring-coupled brake.

* * * * *